US006722299B2

(12) United States Patent
Nöltge et al.

(10) Patent No.: US 6,722,299 B2
(45) Date of Patent: Apr. 20, 2004

(54) CNC CONTROLLED BUTTONHOLE SEWING MACHINE

(75) Inventors: Thomas Nöltge, Bielefeld (DE); Heinz Fransing, Melle (DE); Andreas Oberndörfer, Bielefeld (DE); Theodor Janocha, Bielefeld (DE)

(73) Assignee: Dürkopp Adler Aktiengesellschaft (DE)

( * ) Notice: Subject to any disclaimer, the term of this patent is extended or adjusted under 35 U.S.C. 154(b) by 0 days.

(21) Appl. No.: 10/310,597

(22) Filed: Dec. 5, 2002

(65) Prior Publication Data

US 2003/0131770 A1 Jul. 17, 2003

(30) Foreign Application Priority Data

Dec. 21, 2001 (DE) ..... 101 63 229
Apr. 16, 2002 (DE) ..... 102 16 808

(51) Int. Cl.[7] ..... D05B 3/08
(52) U.S. Cl. ..... 112/70; 112/470.06

(58) Field of Search ..... 112/70, 73, 65, 112/66, 68, 470.06, 446, 447, 475.25

(56) References Cited

U.S. PATENT DOCUMENTS 4,312,283 A 1/1982 Fischer et al.

FOREIGN PATENT DOCUMENTS

| | | |
|---|---|---|
| DE | 457750 | 3/1928 |
| DE | 198 10 205 C 1 | 7/1999 |
| DE | 100 22 238 A 1 | 11/2000 |

*Primary Examiner*—Peter Nerbun
(74) *Attorney, Agent, or Firm*—James B. Conte; Barnes & Thornburg

(57) ABSTRACT

A CNC controlled buttonhole sewing machine comprises work piece clamps with sliding drives for displacement from an initial position of spread, by a length of spread, into a final position of spread. The sliding drive is an electric positioning motor that is allocated to a work piece clamp. Further provision is made for a control unit with data storage, in which to store data, for displacement of the work piece clamp by a given length of spread.

10 Claims, 5 Drawing Sheets

CNC CONTROLLED BUTTONHOLE SEWING MACHINE

BACKGROUND OF THE INVENTION

1. Field of the Invention

The invention relates to a CNC controlled buttonhole sewing machine, comprising a needle, which is drivable via an arm shaft; an x-y table, which is movable by an x drive in an x direction and by a y drive in a y direction, and which supports a first and a second work piece clamp, the first and second work piece clamps being mounted for displacement relative to each other, and which comprises a sliding drive for displacement of the work piece clamps from an initial position of spread by a length of spread into a final position of spread; and a control unit for control of the drives for displacement of the x-y table prior to the start of production of a buttonhole seam.

2. Background Art

The JUKI MEB-3200 Instruction Manual No. 02 29343316 leaflet describes a CNC controlled buttonhole sewing machine of the generic type. It comprises an x-y table which is displaceable on the sewing plane by two stepper motors as x and y drives. Two work piece clamps are disposed on the x-y table, holding a work piece thereon. By means of a pneumatic cylinder, they are displaceable in the x direction on the sewing plane, which is formed by the x-y plane, in mirror symmetry to a center plane. Both pneumatic cylinders are operable by means of a control command that is stored in the control unit. Provided on each side of the x-y table are setscrews, enabling the length of spread of each work piece clamp to be set from a non-modifiable inner initial position of spread to a final position of spread.

Shifting the work piece clamps enables the tightly clamped work piece to be stretched and spread into a tautened plain position. It is possible in this way to produce high quality buttonholes. Stretching the work piece also creates sufficient room for the needle, in case the buttonhole is first cut and then sewn i.e., with the sewing machine working in a so-called pre-conditioning mode. The displacement of each work piece clamp is in the range of 1.0 mm so that the clamps can be moved apart by a length of spread of 2.0 mm. The length of spread depends on various sewing parameters such as the structure of the work piece i.e., material thickness and the like, the kind of threads used for sewing, thread tightening, needle size, possible use of a gimp thread and further parameters.

Drawbacks of the familiar sewing machine reside in that the initial position of spread and the length of spread i.e., the final position of spread, can only be obtained by time-consuming adjustment with the aid of implements such as a screw driver and gauge. This job requires a learned mechanic. The numerous components needed for adjustment are susceptible to wear. It is difficult to retrieve and reproduce set-ups that have been determined empirically. Every modification in buttonhole width requires renewed setting; otherwise it is not possible to clamp the work piece in proximity to the buttonhole seam that is to be produced.

German patent 457 750 describes a spreading mechanism for the work piece clamping arrangement of buttonhole sewing machines which includes work piece clamps that are displaceable, by a mechanism, in symmetry to a center plane. Provision is made for a lever mechanism with a manually adjustable stop, the setting of which modifying the length of spread. This known mechanism also has the above-mentioned drawbacks.

U.S. Pat. No. 4,312,283 teaches an automatic sewing machine, in which a CNC control unit generates coordinates of motion of a sewing machine relative to a work piece holder of adjustable size. For preventing the needle from colliding with the work piece holder, information on the respective size set in the work piece holder is fed to the control unit for the control unit automatically to make a corresponding correction in a sewing program.

SUMMARY OF THE INVENTION

It is an object of the invention to further develop a CNC controlled buttonhole sewing machine of the generic type so that the range of spread can be set by an operator to comply with respective sewing requirements at a minimum expenditure of time and without any need of aids.

According to the invention this object is attained by the features which are characterized in that the sliding drive at least of the first work piece clamp is an electric positioning motor; and in that the control unit includes a data storage with data stored therein for displacement of the at least one first work piece clamp by a given length of spread. The solution according to the invention ensures that the length of spread can be given very conveniently by control unit input so that the ranges in length of spread that correspond to the respective sewing conditions are easily adjustable. This includes work piece quality, buttonhole seam parameters, ranges of tightening of the threads sewn. This will increase the quality of a buttonhole by very precise adjustment of the final position of spread after displacement, by the length of spread, of the work piece clamps from the initial position of spread into the final position of spread. Initial position of spread means the distance of the work piece clamps in their close side-by side position of rest. Final position of spread means a position of the work piece clamps in which they are moved out of the initial position by the length of spread. These adjustment and input jobs can be managed by the operator which means great convenience of handling. Adjustment is feasible without the need of special aids. Machine down-times are kept low because very little time is consumed by the adjustment jobs. The operating mechanic is relieved. The entered control data constitute a basis for further processing of the set-ups in a display and/or for calling stored sewing programs. Manufacturing high quality buttonholes becomes reproducible.

In keeping with a further development, data are stored in the data storage, for displacement at least of the first work piece clamp in relation to the second work piece clamp into an initial position of spread. This ensures that also the initial position of spread can be suited to the envisaged shape and size of a buttonhole seam, enabling the work piece to be clamped in proximity to the seam that is to be sewn. This results in especially reliable stitch forming and excellent buttonhole quality.

In keeping with the especially advantageous embodiment, only a single work piece clamp must be movable on the x-y table, a compensating motion being produced by the possibility of displacement of the x-y table. This reduces the number of components required, leading to more reliable operation and a lower manufacturing cost.

High simplicity of design is accomplished in that the first and the second work piece clamp are displaceable one in relation to the other in an opposite direction, and in that the first and second work piece clamps are displaceable by only a single sliding drive.

In keeping with an advantageous embodiment, no forces are transmitted to the guides of the work piece clamp on the x-y table at least by the displaceable work piece clamp. No frictional forces that might oppose the displacement of the work piece clamp for spreading are occasioned in positioning the work piece clamp. The forces that occasion when a work piece is clamped are kept within the work piece clamp itself. This works in favor of the rapidity and accuracy of the spreading job. Lightweight construction of the entire spreading arrangement is possible, saving material consumption.

Details of the invention will become apparent from the ensuing description of three exemplary embodiments, taken in conjunction with the drawing.

DESCRIPTION OF THE PREFERRED EMBODIMENTS

Figure 1:
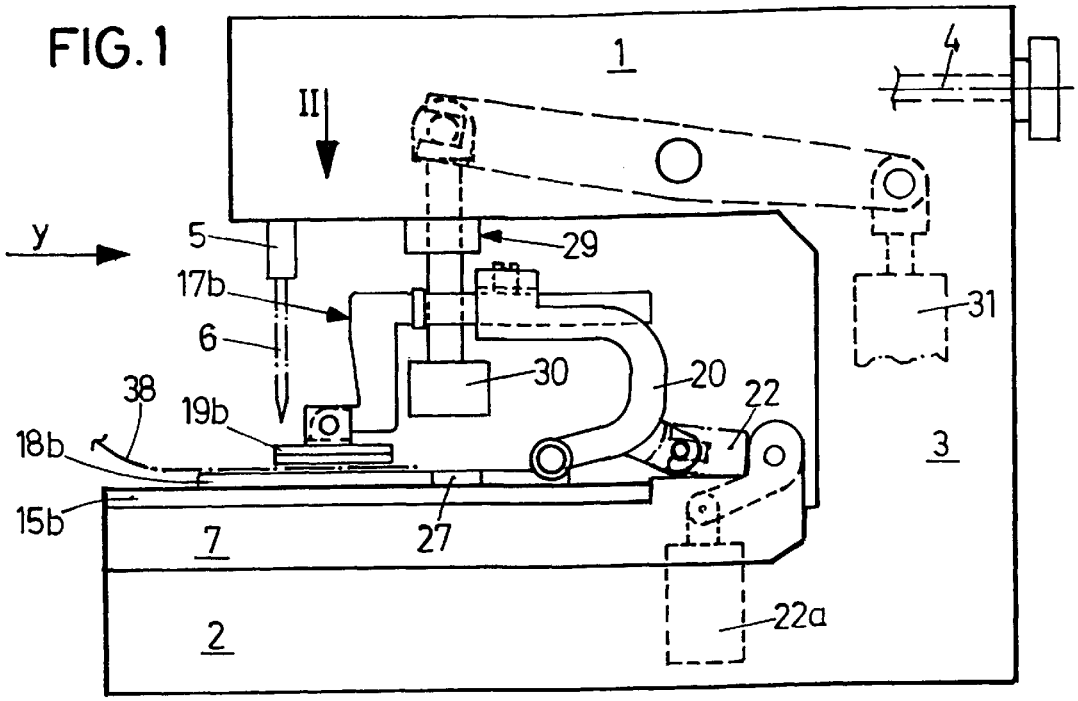
FIG. 1 is a lateral view of a buttonhole sewing machine.
Figure 2:
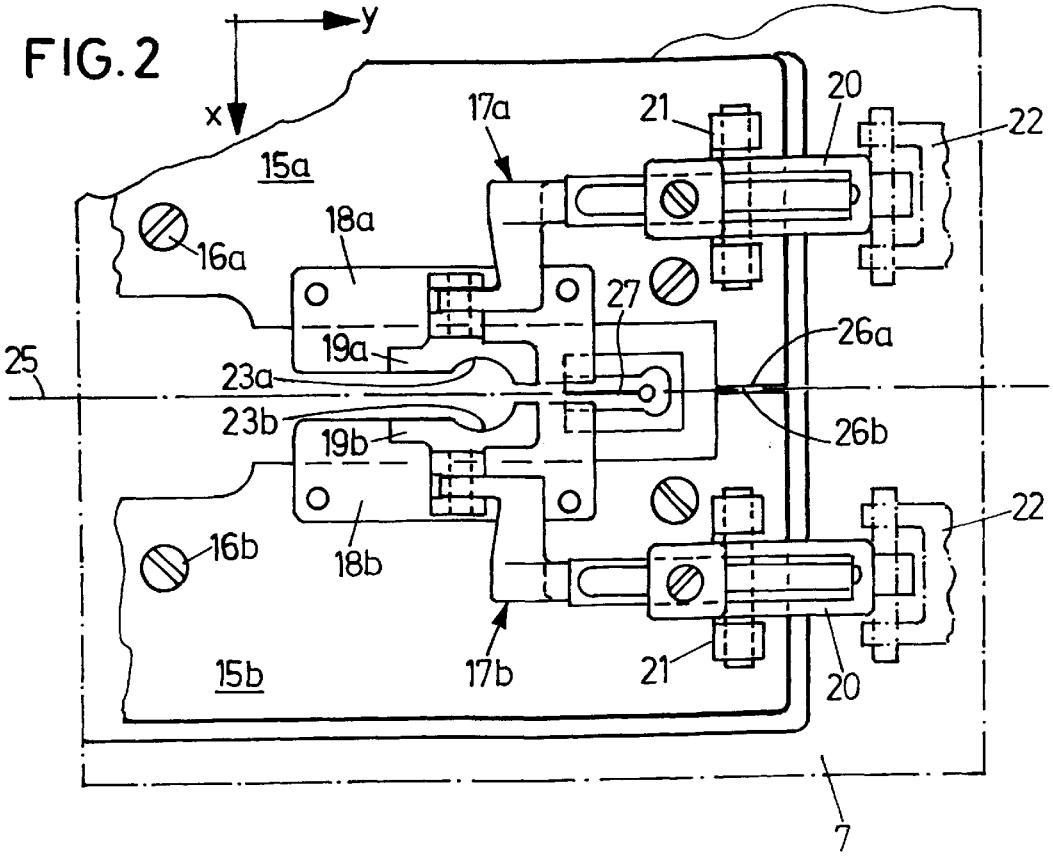
FIG. 2 is a partial plan view of an x-y table of the sewing machine in accordance with the arrow II of FIG. 1.
Figure 5:
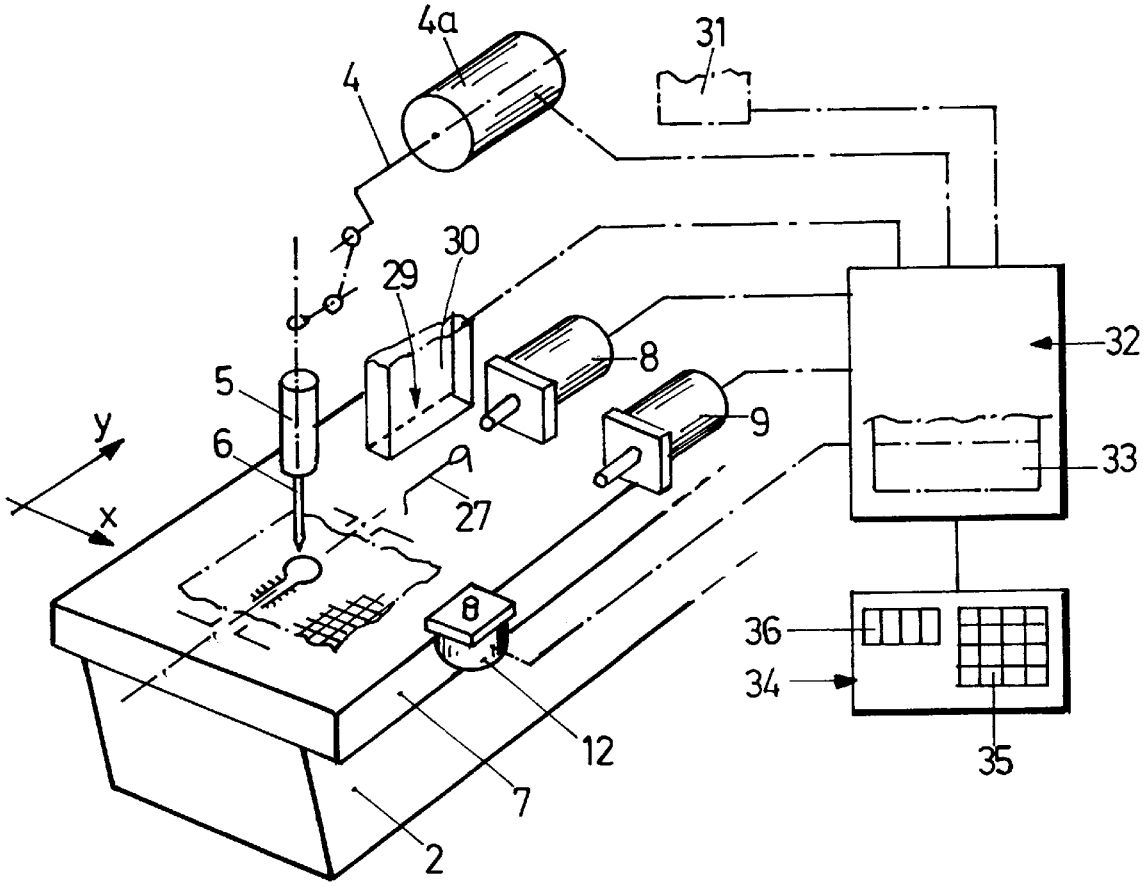
FIG. 5 is a perspective view of part of the buttonhole sewing machine, inclusive of the linkage in circuit of the various drives with the control unit and the operating unit.

As seen in FIG. 1, a buttonhole sewing machine is C shaped, having a top arm 1, a bottom base plate 22 in the form of a casing and an approximately vertical standard 3 that unites the two. An arm shaft 4 is conventionally lodged in the arm 1; it is drivable by a motor 4*a* which is only roughly outlined in FIG. 5. The actuation of a vertically displaceable needle bar 5 with a needle 6 and a jogging drive mechanism therefor customarily derive from the arm shaft 4.

Disposed on the base plate 2 is an x-y table 7 which is a cross slide that is movable in two horizontal coordinate directions, namely the x and the y direction. The x-y table 7 is of conventional design as known for example from U.S. Pat. No. 6,095,066. Actuation of the x-y table 7 takes place by drives roughly outlined only in FIG. 5, namely an x drive 8 and a y drive 9, which are electric positioning motors, preferably stepper motors or controllable D.C. motors.

Figure 3:
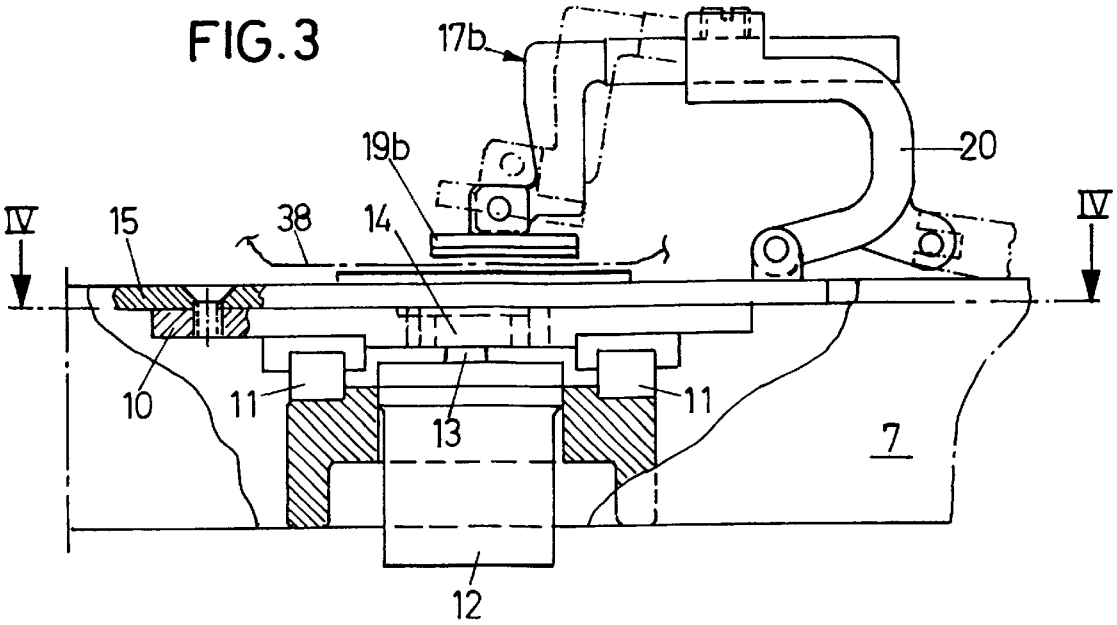
FIG. 3 is a partial view of the sewing machine on an enlarged scale as compared to FIG. 1, in an illustration partially broken open.
Figure 4:
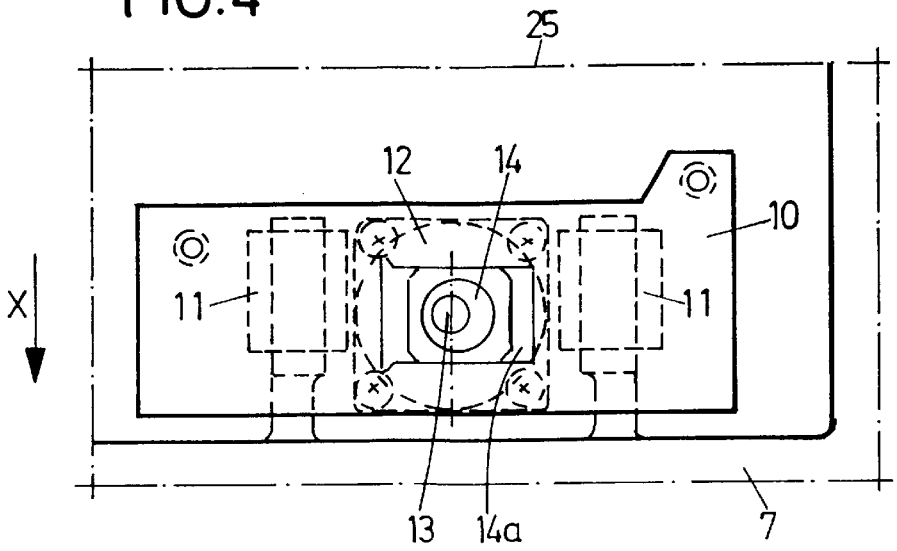
FIG. 4 is a plan view of the part of the sewing machine seen in FIG. 3 on the line IV—IV of FIG. 3.

Disposed on the x-y table 7 is a base plate 10 by way of which a linear ball bearing guide 11 is supported on the x-y table 7 for displacement in the x direction. It is movable in the x direction by a sliding drive 12 in the form of a stepper motor. As seen in FIGS. 3 and 4, this drive 12 is mounted on the x-y table 7, acting on the base plate 10 by way of a cam 14, which is mounted on its shaft 13, and a crosshead sliding connection 14*a*, which cooperates therewith, so that maximum displacements of the base plate 10 in the x direction are possible, corresponding to twice the eccentricity of the cam 14. The lengths of displacement are in the range of approximately 2 mm.

A two-piece supporting plate 15*a*, 15*b* is arranged above the base plate 10. The left sectional supporting plate 15*a*—seen in the y direction—is mounted by screws 16*a* on the x-y table 7; it is stationary thereon. As opposed to this, the right sectional supporting plate 15*b*—seen in the y direction—is mounted by screws 16*b* on the displaceable base plate 10; it is movable along with the base plate 10 in the x direction. The top sides of the sectional supporting plates 15*a*, 15*b* are located on a joint x-y plane.

A work piece clamp 17*a* and 17*b* is mounted on each sectional supporting plate 15*a* and 15*b*, comprising a sectional bearing plate 18*a*, 18*b* which is mounted on the respective sectional supporting plate 15*a*, 15*b* and to each of which is allocated a clamping plate 19*a* and 19*b*, respectively. The clamping plates 19*a*, 19*b* are mounted on bearing levers 20 which are lodged by means of a pivot bearing 21 on the associated sectional supporting plate 15*a* and 15*b*. The work piece clamps 17*a* and 17*b*—apart from their pivotability about the pivot bearing 21—are stationary relative to the respective sectional supporting plate 15*a*, 15*b*. The work piece clamps 17*a*, 17*b* are pivoted by actuating levers 22 which are operated by a pneumatically actuated clamping drive 22*a*. The respective sectional bearing plate 18*a*, 18*b* and the respective clamping plate 19*a* and 19*b* have sectional openings 23*a*, 23*b* that combine to form an opening which, at a small distance, encloses a buttonhole seam 24 that is to be produced.

The sectional supporting plates 15*a*, 15*b* can be moved towards each other, abutting on a vertical center plane 25 where they and the work piece clamps 17*a*, 17*b* have their respective zero position. In this position, the opposing edges 26*a*, 26*b* of the sectional supporting plates 15*a*, 15*b* bear against each other. On this plane 25, a stationary knife 27 for cutting a buttonhole 28 is disposed on the base plate 2 of the sewing machine. This knife 27 is part of a cutting device 29 which also includes an anvil 30 mounted on the bottom side of the arm 1 by means of a cutting drive 31.

The sewing machine is provided with a control unit 32 which triggers the x drive 8, the y drive 9, the sliding drive 12, the drives 22*a* for the work piece clamps 17, 17*b*, the driving motor 4*a* of the arm shaft 4 and the cutting drive 31. The control unit 32 comprises a storage element 33. Furthermore, an operating unit 34 is allocated to the control unit 32, having a keyboard 35 and a display 36.

Programs and data are stored in the storage element 33, concerning the initial position of spread and the buttonhole seam 24 that is to be produced. Furthermore, lengths of spread are stored, which are allocated to the type and shape of the buttonhole seam 24 and the material quality.

Before a sewing operation is started, the drives 8, 9 in the form of stepper motors conventionally move the x-y table 7 in accordance with the data stored in the storage element 33 into a zero position, in which the edges 26*a*, 26*b* of the sectional supporting plates 15*a*, 15*b* abut on the plane 25 and the center plane 25 also holds the needle 6 in its vertical central position. Zero positioning of this type is general practice in sewing control technique and does not require any further explanation. By corresponding actuation of the operating unit 34, the operator selects a certain type of buttonhole 28 with a buttonhole seam 24. The operator also calls a corresponding control program which the material data and the like are allocated to.

The mentioned zero positioning takes place automatically by input of the start of the sewing operation. Corresponding triggering of the sliding drive 12 moves the base plate 10, together with the sectional supporting plate 15*b* and the work piece clamp 17*b*, into an initial position of spread in which the longitudinal edges 37*a*, 37*b*, defining the sectional openings 23*a*, 23*b*, of the clamping plates 19*a*, 19*b* have a distance a from each other that corresponds to the total width b of the buttonhole seam 24 plus a distance c of for instance 0.5 mm between the buttonhole seam 24 and each neighboring longitudinal edge 37*a* and 37*b*. If the clamping plates 19*a*, 19*b*, by their sectional openings 23*a*, 23*b*, are adapted to the buttonhole seam 24 that is to be produced, then there is no need of any adjustment operation of the type mentioned above; only the x-y table 7 has to be set to zero position.

Figure 6:
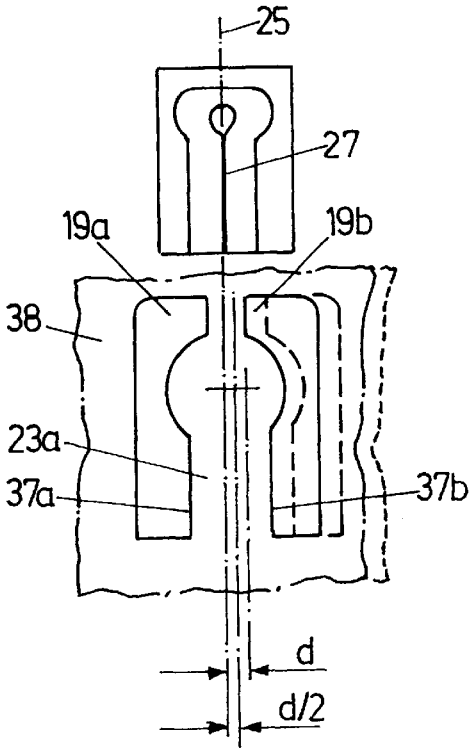
FIG. 6 is a plan view of component parts on an enlarged scale as compared to FIG. 2.
Figure 7:
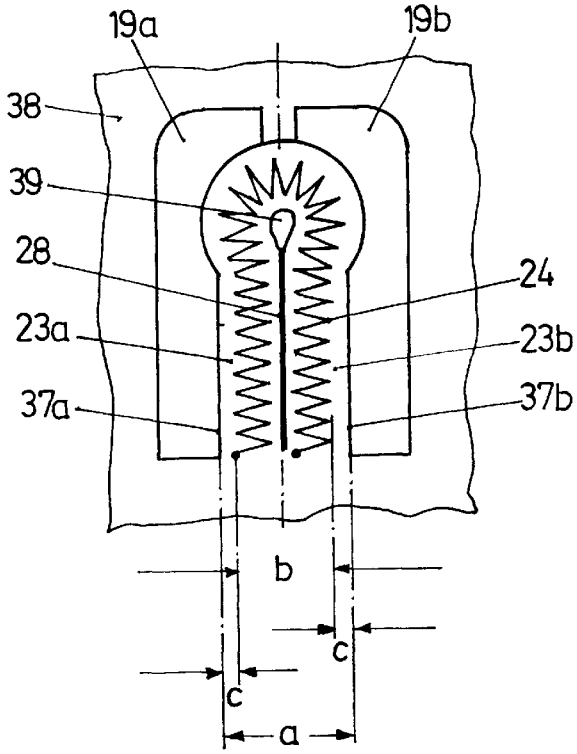
FIG. 7 is a plan view of a work piece with an eye buttonhole.

Then the operator releases the work piece clamps 17*a*, 17*b* via the operating unit 34 or automatically in accordance with the stored sewing program; the operator may then place and align the work piece 38 on the bearing plates 18*a*, 18*b*. Subsequently, the work piece clamps 17*a*, 17*b* are closed by corresponding actuation of the drive 22*a* so that the work piece 38 is clamped by both work piece clamps 17*a*, 17*b*. Afterwards, displacement of the base plate 10, together with the work piece clamp 17*b*, in the x direction by the length of spread d stored in the storage element 33 takes place fully automatically by means of the sliding drive 12. Simultaneously or directly afterwards, the x-y table 7 is moved by a length d/2 in the reversed direction so that the two bearing plates 18*a*, 18*b* are in their final position of spread again in mirror symmetry to the center plane 25. As a result, the sectional openings 23*a*, 23*b* are again in mirror symmetry to the center plane 25. The clamped and spread work piece 38 is positioned underneath the needle 6 in a position that is precisely defined for execution of the sewing operation. Solid lines in FIG. 6 illustrate the initial position of the clamping plate 19*b* and dashed lines show the position of spread after displacement of the base plate 10 by the length of spread d but prior to compensation through reversal of the x-y table 7 by half the length of spread d/2. Cutting the buttonhole 28 by means of the knife 27 may take place prior to the buttonhole 28 sewing job or afterwards. As seen in FIG. 7, the buttonhole seam 24 is a conventional flat stitch seam produced by a corresponding needle jogging drive of the needle bar 5. Stay stitches (not shown) may be sewn additionally at the end of the buttonhole seam 24 that is opposite the buttonhole eye 39.

Figure 8:
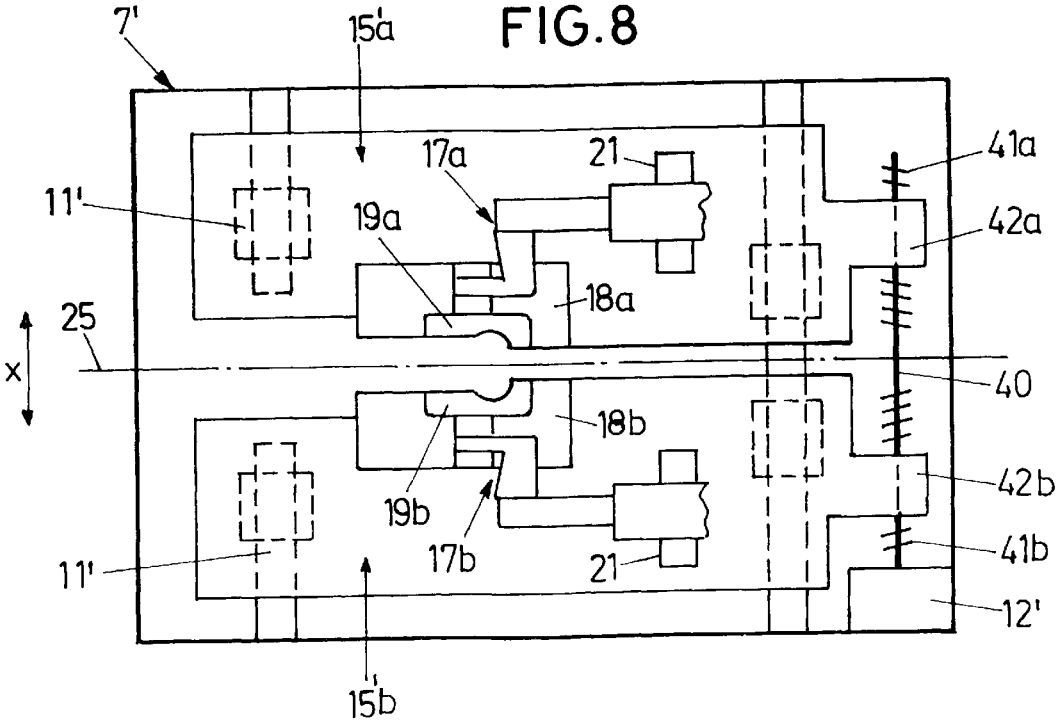
FIG. 8 is a diagrammatic view of a second embodiment of the invention.

FIG. 8 diagrammatically illustrates another embodiment in which two supporting plates 15'*a*, 15'*b* are disposed on the x-y table 7' for displacement in the x direction on linear ball bearing guides 11'. A spindle 40 serves for displacement, having opposed threads 41*a*, 41*b* that engage with spindle nuts 42*a*, 42*b*. The spindle nuts 42*a*, 42*b* are joined to the supporting plates 15'*a*, 15'*b*. By corresponding triggering of the sliding drive 12' on the x-y table 7', the supporting plates 15'*a*, 15'*b* are moved in the x direction towards or away from each other in mirror symmetry to the center plane 25. The work piece clamps (not shown in FIG. 8) are disposed on the supporting plates 15'*a*, 15'*b* in the same way as in the embodiment described above. Zero positioning of the x-y table 7' also takes place in the embodiment of FIG. 8; spreading of the work piece clamps (not shown) together with the work piece takes place in the same way; however, there is no need of compensation of the length of spread by reversal of the x-y table 7' by half the length of spread d/2.

Figure 9:
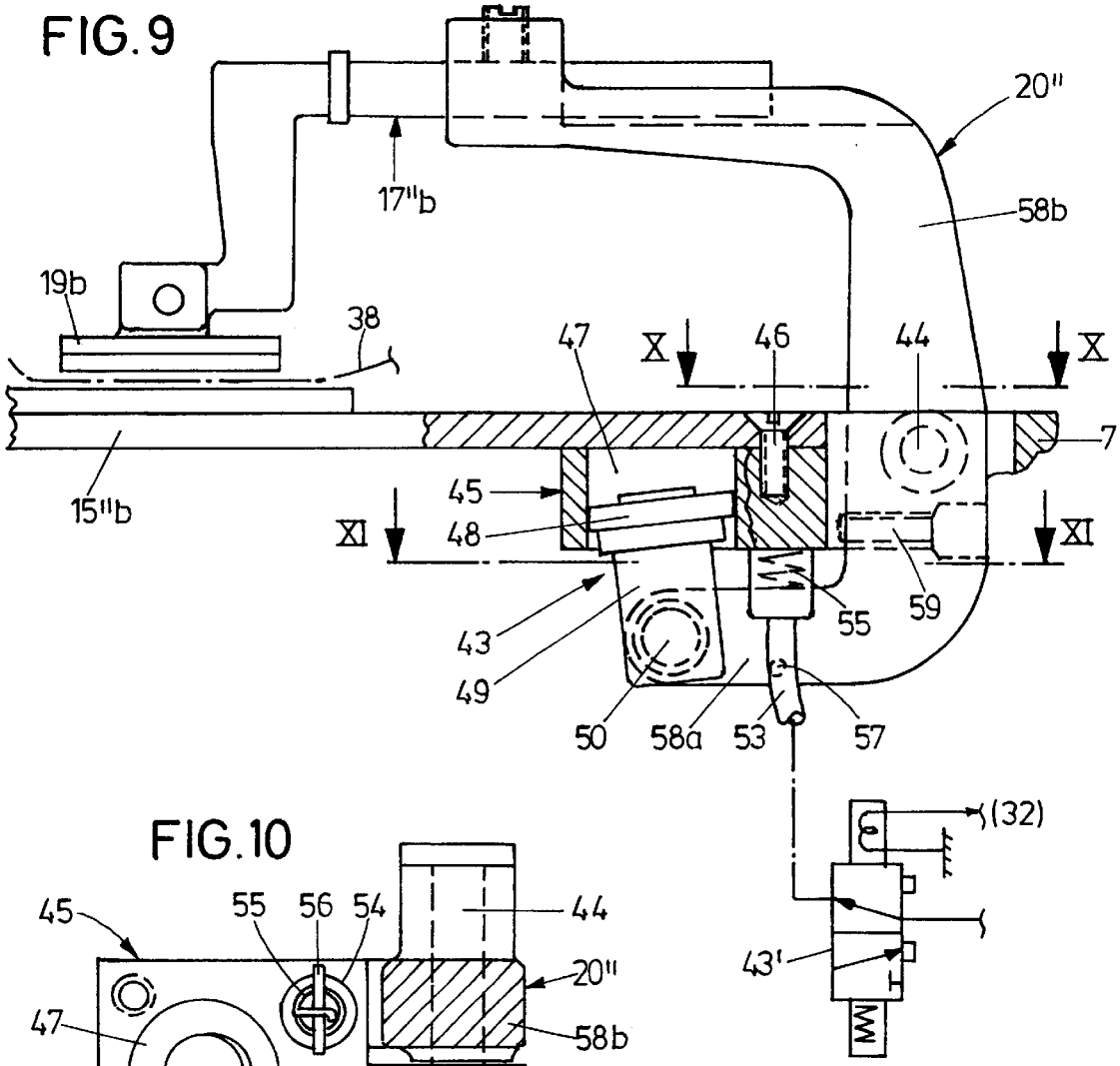
FIG. 9 is a partial lateral view of a third embodiment of the invention.
Figure 10:
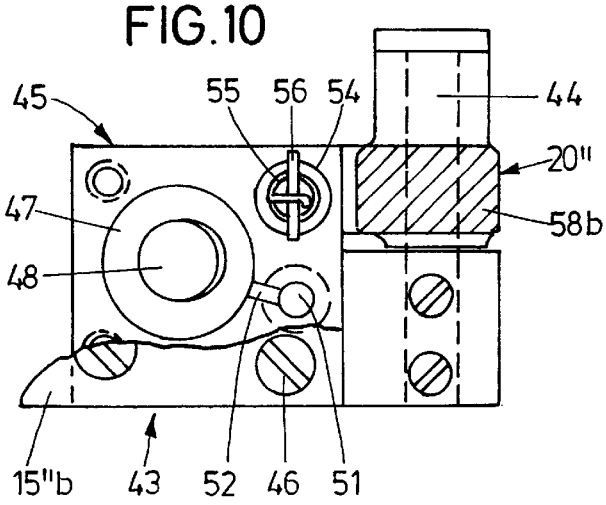
FIG. 10 is a horizontal section of the third embodiment on the line X—X of FIG. 9.
Figure 11:
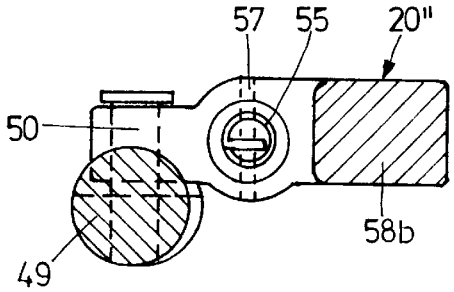
FIG. 11 is a cross-sectional view of the third embodiment on the line XI—XI in FIG. 9.

In the embodiment according to FIGS. 9 to 11 two supporting plates are disposed on an x-y table 7, of which only the supporting plate 15"*b* is outlined. Design and positioning correspond to the first embodiment. This embodiment differs from those described above in that at least the work piece clamp 17"*b*, which is mounted on the supporting plate 15"*b* that is movable relative to the x-y table 7, is operated by a clamping drive 43 that is mounted on the supporting plate 15"*b*. To this end, the double-armed bearing lever 20", which carries the clamping plate 19*b*, is mounted by a pivot bearing 44 in a drive and bearing casing 45 that is fixed by screws 46 to the bottom side of the supporting plate 15"*b*. Both parts are joined together on their contact surfaces for compressed-air tightness by use of a liquid sealant (not shown).

Formed in the casing 45 is a cylindrical chamber 47, which is open upwards and downwards and in which a piston 48 is sealed and disposed for up and down motion. This piston 48 comprises a piston rod 49 which extends downwards from the cylindrical chamber 47 and which is articulated by a joint 50 to the end, turned towards the piston rod 49, of the bearing lever 20". A compressed-air duct 51 is formed by the side of the cylindrical chamber 47 in the casing 45; on the top side of the casing 45, the duct 51 is connected to the cylindrical chamber 47 by means of an overflow conduit 52. This unit constitutes a unilaterally actuated pneumatic piston-cylinder unit. On the bottom side of the casing 45, a compressed-air pipe 53 opens into the compressed-air duct 51; it includes a solenoid valve 43' that is triggered by the control unit 32.

A borehole 54 is provided in the casing 45 by the side of the compressed-air duct 51, with a preloaded extension spring 55 disposed therein which is secured to the top side of the casing 45 by a retaining pin 57 and to the bearing lever 20" by another retaining pin 57. By means of the preloaded extension spring 55, the lever section 58*a* between the pivot axis 44 and the joint 50 is pulled upwards towards the clamping drive 43 so that the lever 58*b* of the bearing lever 20" is pivoted upwards i.e., the clamping plate 19*b* is lifted off the supporting plate 15"*b*. If, however, compressed air flows via the compressed-air pipe 53, the compressed-air duct 51 and the overflow conduit 52 into the chamber 47 above the piston 48, then the piston 48, inclusive of the lever section 58*a*, is shifted upwards counter to the force of the extension spring 55 so that the lever section 58*b*, together with he clamping plate 19*b*, is pivoted towards the supporting 15"*b*, whereby any possibly available work piece 38 is clamped.

A setscrew 59 is disposed in the lever section 58*a*, bearing against the casing 45; it serves to adjust the length by which the clamping plate 19*b* is lifted.

Arranging the clamping drive 43 between the bearing lever 20" and the supporting plate 15"*b* ensures that the forces that act within the work piece clamp 17"*b* are kept within the clamp and do not act on the x-y table 7".

The other supporting plate and clamping plate are embodied in the same way. This design of the work piece clamps can be put into practice not only in the exemplary embodiment according to FIGS. 1 to 7, but also in the embodiment of FIG. 8.

What is claimed is:

1. A CNC controlled buttonhole sewing machine, comprising a needle (6), which is drivable via an arm shaft (4);

an x-y table (7, 7'), which is movable by an x drive (8) in an x direction and by a y drive (9) in a y direction, and which supports a first and a second work piece clamp (17*a*, 17*b*, 17"*b*), the first and second work piece clamps (17*a*, 17*b*, 17"*b*) being mounted for displacement relative to each other, and which comprises a sliding drive (12, 12') for displacement of the work piece clamps (17*a*, 17*b*, 17"*b*) from an initial position of spread by a length of spread d into a final position of spread; and a control unit (32) for control of the drives (8, 9, 12, 12') for displacement of the x-y table (7, 7') prior to the start of production of a buttonhole seam (24), wherein the sliding drive (12) at least of the first work piece clamp (17*b*, 17"*b*) is an electric positioning motor; and wherein the control unit (32) includes a data storage (33) with data stored therein for displacement of the at least one first work piece clamp (17*b*, 17"*b*) by a given length of spread d.

2. A buttonhole sewing machine according to claim 1, wherein data are stored in the data storage (33), for displacement at least of the first work piece clamp (17*b*, 17"*b*) in relation to the second work piece clamp (17*a*) into an initial position of spread.

3. A buttonhole sewing machine according to claim 1, wherein only the first work piece clamp (17*b*, 17"*b*) is displaceable in relation to the x-y table (7) and the second work piece clamp (17*a*) is stationary in relation to the x-y table (7); and wherein data are stored in the control unit (32) for displacement of the first work piece clamp (17*b*, 17"*b*) by a given length of spread d and for displacement of the x-y table (7) in a reversed direction by half the given length of spread d.

4. A buttonhole sewing machine according to claim 1, wherein the first and the second work piece clamp (17*a*, 17*b*, 17"*b*) are displaceable one in relation to the other in an opposite direction.

5. A buttonhole sewing machine according to claim 4, wherein the first and second work piece clamps (17*a*, 17*b*, 17"*b*) are displaceable by only a single sliding drive (12').

6. A buttonhole sewing machine according to claim 1, wherein the electric positioning motor is a stepper motor.

7. A buttonhole sewing machine according to claim 1, wherein at least the first work piece clamp (17"*b*) comprises a supporting plate (15"*b*) for accommodation of a work piece (38) and a clamping plate (19*b*) mounted on the supporting plate (15"*b*); and wherein a clamping drive (43) for actuation of the clamping plate (19*b*) supports itself on the supporting plate (15"*b*).

8. A buttonhole sewing machine according to claim 7, wherein the clamping drive (43) is a pneumatic piston-cylinder drive.

9. A buttonhole sewing machine according to claim 8, wherein the clamping drive (43) comprises a drive casing (45) mounted on the supporting plate (15"*b*) and having a cylindrical chamber (47) in which a piston (48) is arranged for displacement, the piston (48) being connected to a bearing lever (20") which carries the clamping plate (19*b*).

10. A buttonhole sewing machine according to claim 8, wherein the clamping drive (43) is a unilaterally actuated piston-cylinder drive.

* * * * *